US007189136B1

(12) United States Patent
Ehm

(10) Patent No.: US 7,189,136 B1
(45) Date of Patent: Mar. 13, 2007

(54) APPARATUS FOR THE RETENTION OF ITEMS

(76) Inventor: Randi J. Ehm, 570 Yorkshire Ter., Lewisville, TX (US) 75067

( * ) Notice: Subject to any disclaimer, the term of this patent is extended or adjusted under 35 U.S.C. 154(b) by 0 days.

(21) Appl. No.: 10/909,658

(22) Filed: Aug. 2, 2004

(51) Int. Cl.
*A63H 33/42* (2006.01)
*A63H 33/00* (2006.01)

(52) U.S. Cl. ..... 446/227; 446/901

(58) Field of Classification Search ..... 40/587, 40/617; 446/108–123, 227, 901
See application file for complete search history.

(56) References Cited

U.S. PATENT DOCUMENTS 2,187,524 A * 1/1940 Walter ..... 273/348.2
D122,424 S * 9/1940 Singer ..... D21/386
D125,096 S * 2/1941 Singer ..... D21/386
3,177,611 A * 4/1965 Beck ..... 446/114
3,290,817 A * 12/1966 Stanley ..... 446/227
5,066,018 A * 11/1991 Hinton ..... 473/572
5,199,716 A * 4/1993 DeFluiter et al. ..... 473/572
5,938,497 A * 8/1999 Mott ..... 446/122
6,016,926 A * 1/2000 Smith et al. ..... 211/119.011
6,318,300 B1 * 11/2001 Renforth et al. ..... 119/708
6,464,555 B1 * 10/2002 Paduano ..... 446/227
6,606,768 B2 * 8/2003 Henry et al. ..... 24/306
6,824,000 B2 * 11/2004 Samelson ..... 211/105.3

* cited by examiner

*Primary Examiner*—Kien Nguyen
(74) *Attorney, Agent, or Firm*—Lanier Ford Shaver & Payne PC; Angela Holt; Frank M. Caprio

(57) ABSTRACT

An apparatus for retaining children's toys and other materials within a retrievable distance is provided. The apparatus may comprise a generally geometrically-shaped main body with a plurality of integrally formed ribs. The ribs divide the outer periphery of the main body into a plurality of segments for the attachment of multiple toys or other materials, such as, but not limited to, eating utensils, sealed containers, or a pacifier. Each item connected to the main body is connected thereto using an individual strap having hook-and-loop fasteners at each end for securing about said main body's outer periphery or said item. The apparatus may be secured in place using an affixed suction cup or other attachment means for maintaining its placement. Alternatively, said apparatus may be used as a basis for an affixed animal toy or mobile when mounted on a wall or ceiling and the attached items are allowed to dangle therefrom.

14 Claims, 5 Drawing Sheets

APPARATUS FOR THE RETENTION OF ITEMS

BACKGROUND OF THE INVENTION

This invention generally relates to a device for retaining items within a retrievable distance. In particular, the present invention relates to an apparatus for the retention of children's toys and other materials in physical connection with the apparatus. Mote particularly, the present invention relates to a retention apparatus suitable for use in maintaining children's toys, eating utensils, and other materials within a defined distance of the apparatus and in particular, preventing such items from falling off a table or other raised surface.

SUMMARY OF THE INVENTION

The present invention recognizes and addresses various of the foregoing limitations and drawbacks, and others, concerning the need of parents and childcare workers to reduce and/or eliminate the repetitive task of retrieving items a child has dropped onto the floor from a raised surface such as a table or high chair. Therefore, the present invention is primarily directed to retention device for temporarily physically connecting such items to a secured location in such a manner as to make retrieval of the item by the child or the care giver possible without the need to bend down or crawl under a table.

It is, therefore, a principle object of the subject invention to provide a retention device for restraining the movement of items attached thereto. More particularly, it is an object of the present invention to provide such a retention device for the temporary attachment of such items to prevent their fall from a raised surface to a lower surface. In such context, it is still a more particular object of the present invention to provide a retention device capable of temporary physical affixation on such raised surface.

Still further, it is a principle object of this invention to provide a retention device suitable for use around children. It is a further object of the present invention to provide such a device with a plurality of attachment points for the temporary physical attachment of various items to be retained. In such context, it is an object of the present invention to provide a retention device that is divided into a plurality of segments such that its outer periphery provides defined attachment points for such items. Still further, in such context, it is an object of the present invention to provide a removable strap suited for attaching the items being retained to such device while providing some freedom of movement of said device.

Finally, it is an object of the present invention to provide a retention device suitable for the retention of children's toys, including books, eating utensils, capped cups, and pacifiers. In such context, it is the primary object of the present invention to provide a retention device capable of eliminating the repetitive need for a parent or care giver for a child to retrieve such items that have been dropped or thrown to the floor from a raised surface.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description).

These and other features, aspects and advantages of the present invention will become better understood with reference to the following descriptions and appended claims. The accompanying drawings, which are incorporated in and constitute a part of this specification, illustrate an embodiment of the invention and, together with the descriptions, serve to explain the principles of the invention.

In one exemplary embodiment, there may be provided a generally circular retention apparatus having a main body. Such main body may be ring-shaped. Within such main body may be located a plurality of integrally formed ribs that serve to divide the main body into a plurality of segments. Such ribs may extend outward from a centralized hub to the outer periphery of the main body of the apparatus.

Such apparatus may be weighted or have at least one attachment means for temporarily affixing said apparatus to a generally planar surface, such as a table or wall. Such attachment means may be comprised of at least one suction cup or a plurality of hook-and-loop fasteners. In order to temporarily attach various items to be retained by such apparatus, there may be provided at least one connecting means. Such connecting means may include any method of temporary attachment to said device, including but not limited to the use of rope, string, twine, or strapping that allows for the removal of such connecting means from both the apparatus and the item without any permanent physical change to either. In one such exemplary embodiment, the connecting means may be comprised of strapping having hook-and-loop fasteners at both ends sufficient to allow for the securement of an item to said apparatus.

In a second alternative embodiment of the present invention, there may be provided a generally rectangular ring-shaped retention apparatus having a main body. Within such main body may be located a plurality of integrally formed ribs that serve to divide the main body into a plurality of segments. Such ribs may extend outward from a centralized hub to the outer periphery of the main body of the apparatus.

Such apparatus may be weighted or have at least one attachment means for temporarily affixing said apparatus to a generally planar surface, such as a table or wall. Such attachment means may be comprised of at least one suction cup or a plurality of hook-and-loop fasteners. In order to temporarily attach various items to be retained by such apparatus, there may be provided at least one connecting means.

Such connecting means may include any method of temporary attachment to said device, including but not limited to the use of rope, string, twine, or strapping that allows for the removal of such connecting means from both the apparatus and the item without any permanent physical change to either. In one such exemplary embodiment, the connecting means may be comprised of strapping having hook-and-loop fasteners at both ends sufficient to allow for the securement of an item to said apparatus.

In another alternative embodiment of the present invention, there may be provided a generally triangular ring-shaped retention apparatus having a main body. Such apparatus may be weighted or have at least one attachment means for temporarily affixing said apparatus to a generally planar surface, such as a table or wall. Such attachment means may be comprised of at least one suction cup or a plurality of hook-and-loop fasteners. In order to temporarily attach various items to be retained by such apparatus, there may be provided at least one connecting means.

In yet another exemplary embodiment, there may be provided a generally octagonal retention apparatus having a main body. Such main body may be ring-shaped. Within such main body may be located a plurality of integrally formed ribs that serve to divide the main body into a plurality of segments. Such ribs may extend outward from a centralized hub to the outer periphery of the main body of the apparatus.

Such apparatus may be weighted or have at least one attachment means for temporarily affixing said apparatus to a generally planar surface, such as a table or wall. Such attachment means may be comprised of at least one suction cup or a plurality of hook-and-loop fasteners. In order to temporarily attach various items to be retained by such apparatus, there may be provided at least one connecting means.

Such connecting means may include any method of temporary attachment to said device, including but not limited to the use of rope, string, twine, or strapping that allows for the removal of such connecting means from both the apparatus and the item without any permanent physical change to either. In one such exemplary embodiment, the connecting means may be comprised of strapping having hook-and-loop fasteners at both ends sufficient to allow for the securement of an item to said apparatus.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
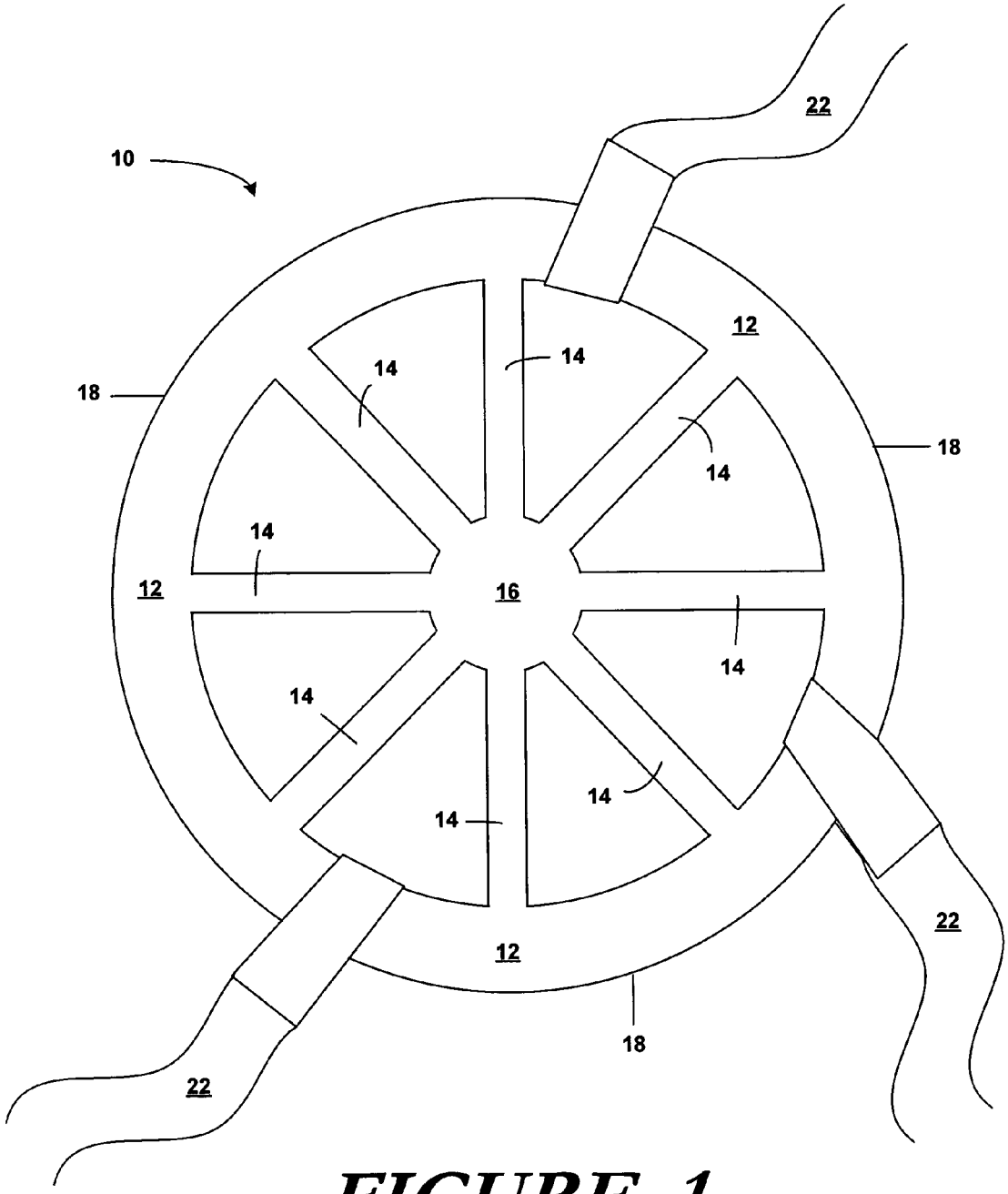
FIG. 1 is a top plan view of one exemplary embodiment of the present invention including a plurality of connector means.

Repeat use of reference characters throughout the present specification and appended drawings is intended to represent the same or analogous features or elements of the various exemplary embodiments of the present invention described and shown.

DETAILED DESCRIPTION OF THE PREFERRED EMBODIMENTS

Reference will now be made in detail to presently preferred embodiments of the invention, examples of which are fully represented in the accompanying drawings. Such examples are provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

As disclosed above, the present invention is particularly concerned with a retention device 10 for preventing the intentional or accidental falling of items from a raised surface 21. In particular, the present invention is concerned with a retention device 10 that will aid parents and caregivers for children to reduce the incidences of retrieving items dropped onto the floor by a child at a table or in a high chair.

Figure 2:
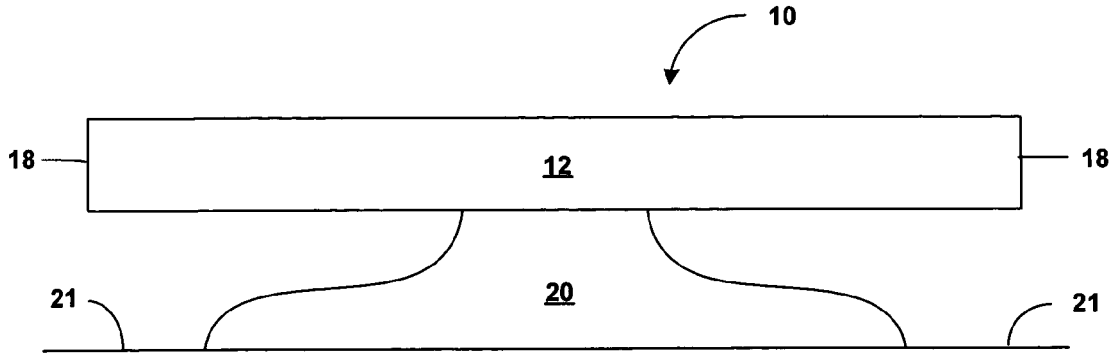
FIG. 2 is side plan view of the exemplary embodiment of FIG. 1 showing the present invention including an attachment means.
Figure 3:
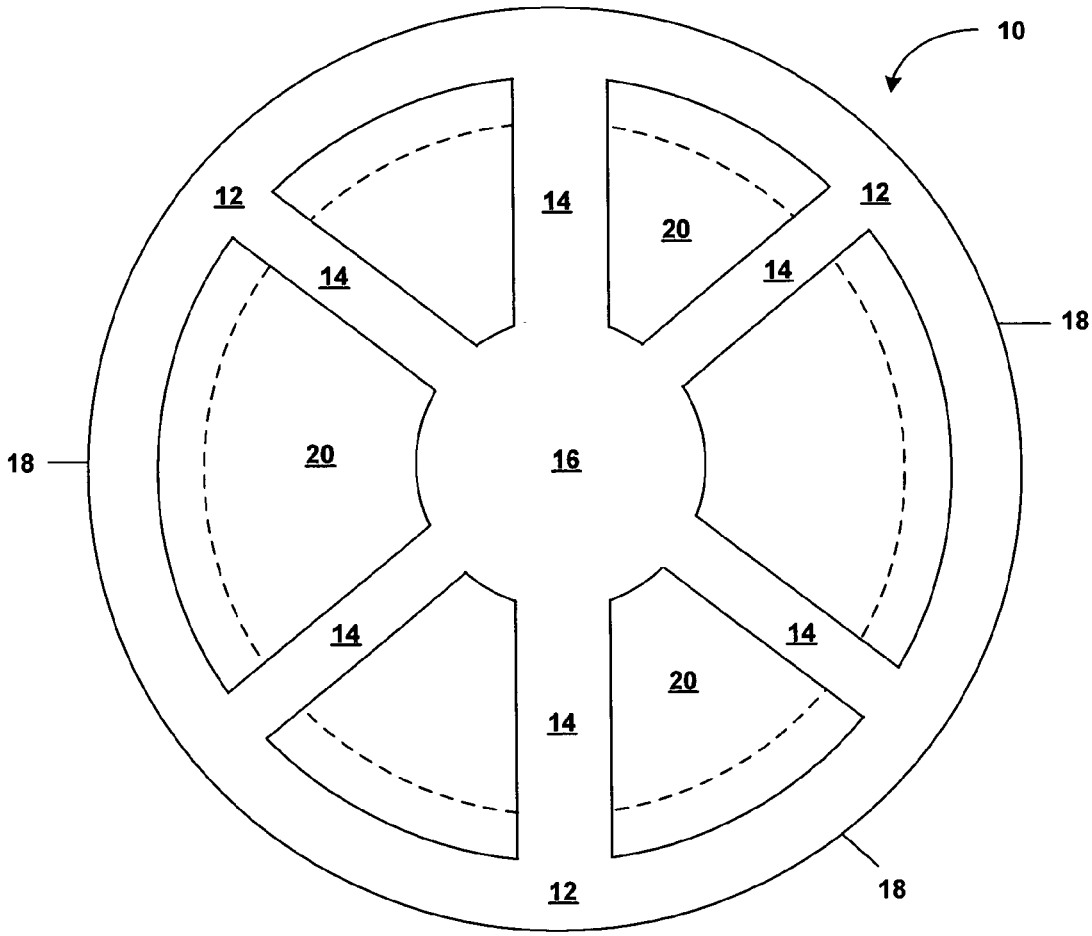
FIG. 3 is a top plan view of an alternative exemplary embodiment of the present invention.

As best seen in FIGS. 1–3, one embodiment of the present invention 10 comprises a generally circular main body 12 that is dissected into a plurality of individual segments by an equal plurality of ribs 14. The ribs 14 are integrally formed with said main body 12 so as to be a single unitary construction. Each of said plurality of ribs 14 extend outward from a centralized hub 16 toward the outer periphery 18 of the main body 12.

To aid in preventing the present invention 10 from falling off a table or other generally planar surface 21, the device 10 may be either weighted or provided with at least one attachment means 20. In the latter case, the attachment means 20 may comprise at least one suction cup or at least one hook-and-loop fastener, such as, but not limited to, VELCRO©. In either case, when a plurality of attachment means 20 are utilized, it is best to offset them to opposite sides of the device 10 as close to the outer periphery 18 of the main body 12 as possible to provide the greatest adhesion of the device 10 to the generally planar surface 21. Where a single attachment means 20 is engaged, it is best to center such attachment means 20 on the centralized hub 16.

Any manner of connecting means 22 may be used to temporarily connect the items being retained by the device 10, including but not limited to, rope, string, twine or strapping. In the preferred embodiment of the present invention, an individual strap 22 is used to effectively tie the item to the retention device 10. Such strap 22 is provided with hook-and-loop fastening material, such as but not limited to VELCRO© at each end of its length. A first end of the strap 22 may be first attached to the main body 12 of the device 10 and the second end of the strap 22 may be attached to the item to be retained. The length of the strap 22 is variable and is determined by a number of factors, but is primarily determined by the height of the raised surface 21 to which the device 10 is attached.

Figure 4:
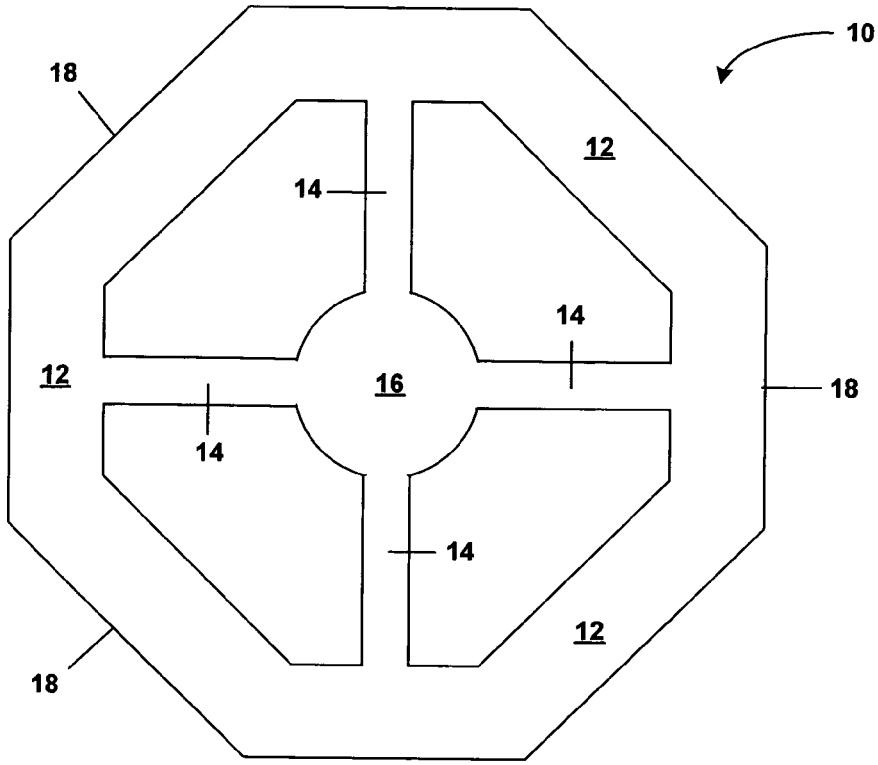
FIG. 4 is a top plan view of an alternative exemplary embodiment of the present invention.

FIG. 4 shows an alternative embodiment of the device 10 of the present invention in which the main body 12 of the device 10 is octagonal in shape. As before, the main body 12 is dissected into a plurality of individual segments by an equal plurality of ribs 14. The ribs 14 are integrally formed with said main body 12 so as to be a single unitary construction. Each of said plurality of ribs 14 extend outward from a centralized hub 16 toward the outer periphery 18 of the main body 12. Also, as before, this alternative embodiment of the present invention 10 may be either weighted or provided with at least one attachment means 20.

Figure 5:
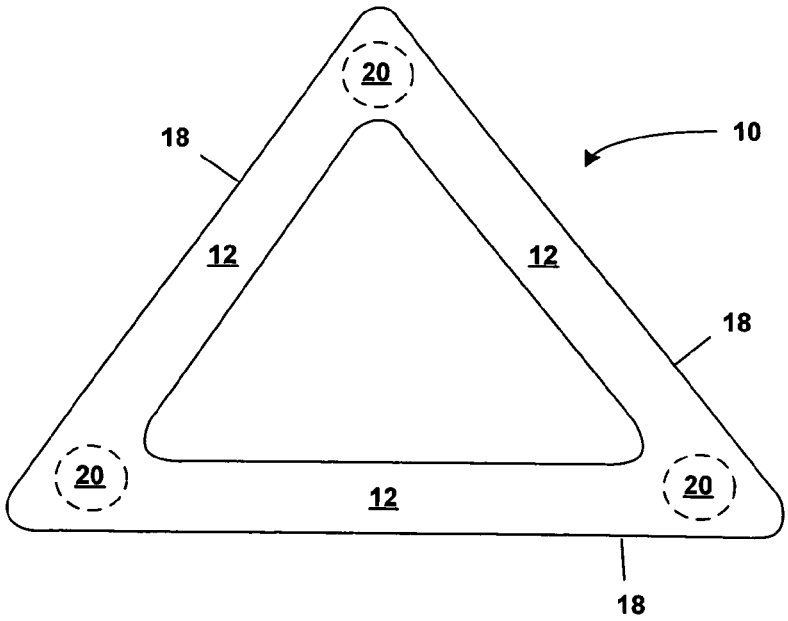
FIG. 5 is a top plan view of an alternative exemplary embodiment of the present invention.

Yet another alternative embodiment is shown in FIG. 5, in which the device 10 of the present invention has a main body 12 that is triangular in shape. As in all the earlier alternative embodiments, the main body 12 may be dissected into a plurality of individual segments by an equal plurality of integrally-formed ribs 14, however, in the embodiment shown, there are no ribs 14 and each leg of the triangular shape serves as an individual segment of the main body 12. In this embodiment, a suction cup 20 is located at each corner of the triangle and act as the attachment means 20 holding the device 10 to a generally planar surface 21.

Figure 6:
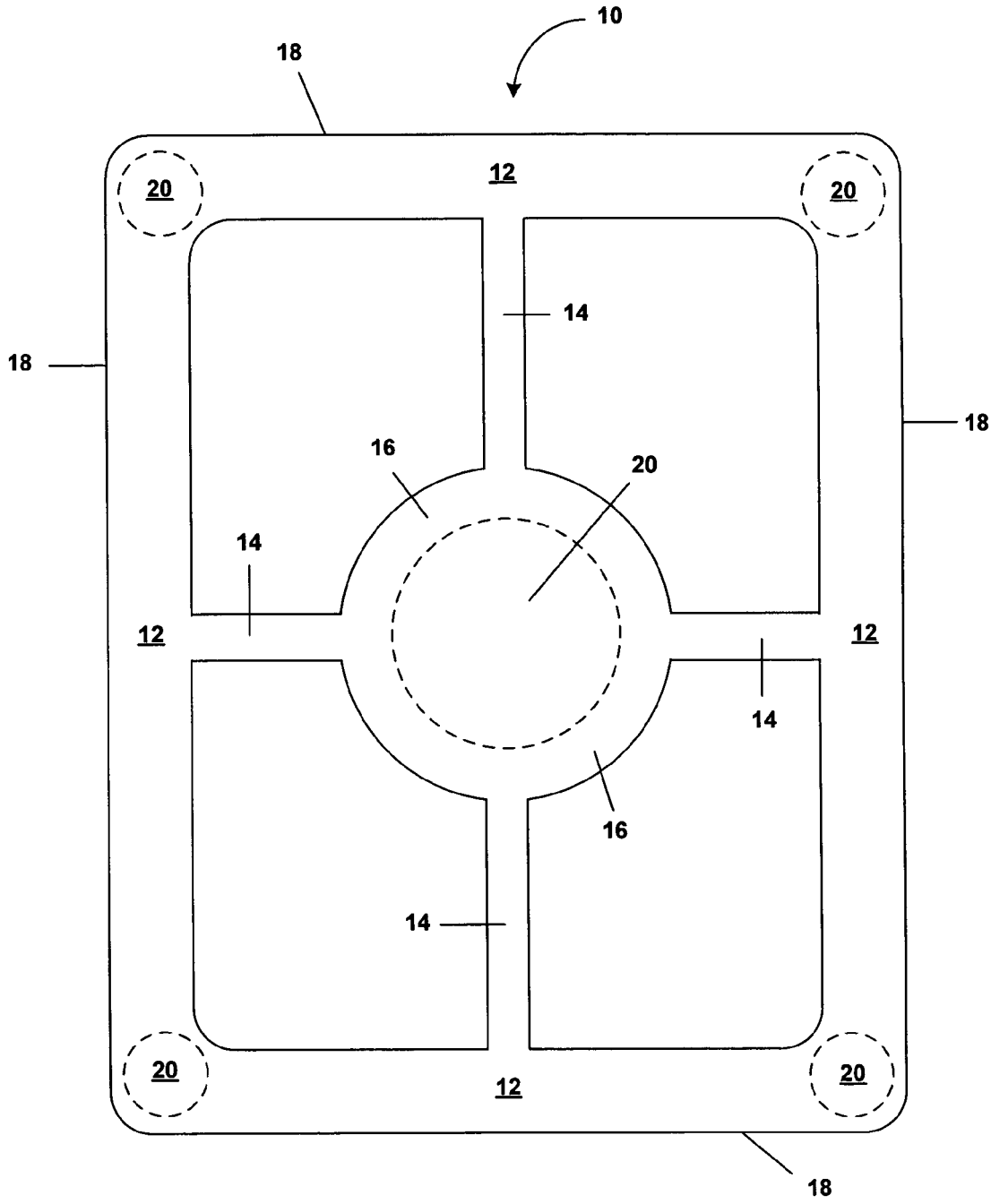
FIG. 6 is a top plan view of an alternative exemplary embodiment of the present invention.

FIG. 6 depicts another alternative embodiment of the present invention in which the device 10 of the main body 12 has a generally rectangular shape. As above, the main body 12 is dissected into a plurality of individual segments by an equal plurality of ribs 14. The ribs 14 are integrally formed with said main body 12 so as to be a single unitary construction. Each of said plurality of ribs 14 extend outward from a centralized hub 16 toward the outer periphery 18 of the main body 12. The device 10 is provided with a plurality of attachment means 20 located at each corner of the main body 12 and at the centralized hub 16.

It should be noted that in all of the above alternative embodiments of the present invention, the main body 12 may be of any shape, size, weight, or color. In the latter case, as the device 10 is primarily intended for use with children, primary colors are preferred. Additionally, the device 10 may be constructed of any suitable material, including, but not limited to, plastic (either molded or extruded), metal, wood, or a composite.

Figure 7:
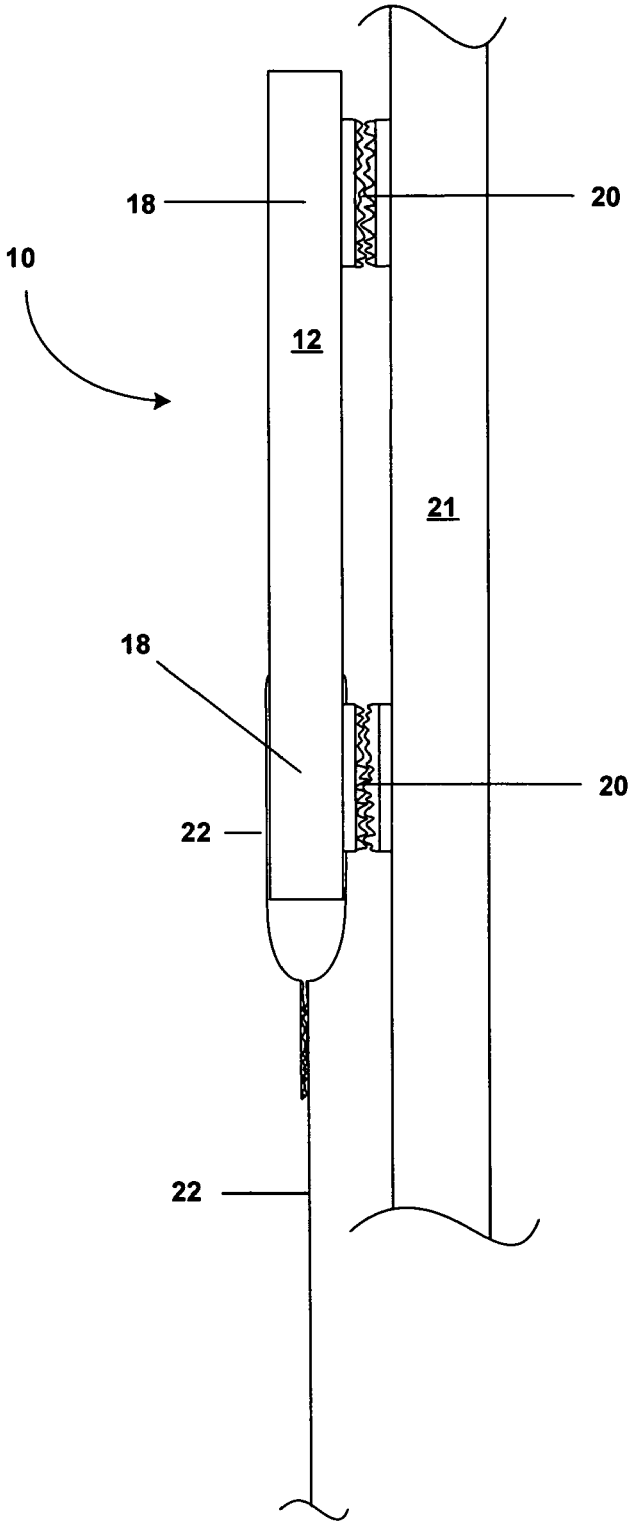
FIG. 7 is a side plan view of an alternative exemplary embodiment of the present invention as mounted on a vertical surface using an alternative attachment means.

Finally, FIG. 7 depicts an alternative use for the present invention in which the device 10 is mounted on a generally vertical surface 21 using a plurality of hook-and-loop attachment means 20. In this configuration, a child's or animal's toy may be suspended from the main body 12 of the present invention using a single connecting means 22. In this exemplary embodiment, the connecting means 22 is similarly using a hook-and-loop fastener to temporarily affix itself about the main body 12. In yet another alternative use, the present invention could be mounted on a ceiling or the bottom of a raised surface to provide the basis for a child's mobile.

Although several preferred embodiments of the invention have been described using specific terms and devices, such descriptions are for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of various other embodiments may be interchanged both in whole or in part. Therefore, the spirit and scope of the appended claims should not be limited to the description of the preferred version contained herein.

What is claimed is:

1. An apparatus capable of retaining a plurality of items within a retrievable distance of a child, said apparatus comprising:

a main body having an outer periphery divided into a plurality of segments by an equal number of internal ribs;

at least one suction cup directly connected to the bottom of the main body, wherein the suction cup is suitable for temporarily affixing said apparatus to the top tabular surface of a child confinement apparatus;

wherein said ribs are integrally formed with said main body and radiate outward toward said main body outer periphery from a centralized hub; and wherein each of said plurality of items is secured to said main body outer periphery by one of a plurality of connecting members, such that a child confined within the child confinement apparatus can retrieve the items without detaching the main body from the tabular surface;

and wherein the plurality of items are child-safe items.

2. An apparatus as in claim 1, wherein said main body is generally circular.

3. An apparatus as in claim 1, wherein each of said connecting members comprises a strap having a first end and a second end, wherein said first end of said strap is secured about said main body outer periphery using hook-and-loop fasteners located generally along said first end of said strap and wherein said second end of said strap is secured to one of said plurality of items using hook-and-loop fasteners located generally along said second end of said strap.

4. An apparatus as in claim 1, wherein said main body is generally rectangular.

5. An apparatus as in claim 1, wherein said main body is generally triangular.

6. An apparatus as in claim 1, wherein the at least one suction cup is located at the interior intersection of the ribs.

7. A child-safe retention device comprising:

a main body, said main body further comprising a centralized hub with a plurality of integrally formed ribs extending therefrom to an outer periphery; and at least one suction cup directly connected to the bottom of the main body, wherein the suction cup is suitable for temporarily affixing said device to the top tabular surface of a child confinement apparatus.

8. A retention device as in claim 7, wherein said main body is generally triangular.

9. A retention device as in claim 7, wherein said main body is generally rectangular.

10. A retention device as in claim 7, wherein said main body is generally circular.

11. A retention device as in claim 7, said at least one connecting means comprises a strap having a first end and a second end, wherein said first end of said strap is secured about said main body outer periphery using hook-and-loop fasteners located generally along said first end of said strap and wherein said second end of said strap is secured to an item to be retained near said retention device using hook-and-loop fasteners located generally along said second end of said strap.

12. A retention apparatus comprising:

a main body;

at least one attachment means directly connected to the bottom of the main body, wherein the attachment means is suitable for removably attaching said apparatus to the top tabular surface of a child confinement apparatus; and at least one connecting means for temporarily affixing at least one item to be retained by said apparatus within a retrievable distance, such that a child confined within the child confinement apparatus can retrieve the at least one item without detaching the main body from the tabular surface.

13. A retention apparatus as in claim 12, wherein said at least one attachment means is a suction cup.

14. A retention apparatus as in claim 12, wherein said at least one item is selected from the group consisting essentially of children's toys, books, eating utensils, capped cups, and pacifiers.

* * * * *